US009285725B2

(12) United States Patent
Nakabayashi

(10) Patent No.: US 9,285,725 B2
(45) Date of Patent: Mar. 15, 2016

(54) IMAGE FORMING APPARATUS WITH SIMPLEX AND DUPLEX OPERATIONS AND CLEANING MODE

(71) Applicant: CANON KABUSHIKI KAISHA, Tokyo (JP)

(72) Inventor: Junichiro Nakabayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 14/065,929

(22) Filed: Oct. 29, 2013

(65) Prior Publication Data

US 2014/0119784 A1 May 1, 2014

(30) Foreign Application Priority Data

Oct. 30, 2012 (JP) ..... 2012-239337

(51) Int. Cl.
*G03G 15/20* (2006.01)

(52) U.S. Cl.
CPC .... *G03G 15/2025* (2013.01); *G03G 2215/2035* (2013.01); *G03G 2215/2083* (2013.01)

(58) Field of Classification Search
CPC ..... G03G 15/2025; G03G 2215/2083; G03G 2215/2035
USPC ..... 399/327, 79, 82
See application file for complete search history.

(56) References Cited

U.S. PATENT DOCUMENTS

| | | | | |
|---|---|---|---|---|
| 5,142,340 | A * | 8/1992 | Farrell et al. | 399/327 |
| 5,865,121 | A * | 2/1999 | Testardi et al. | 101/483 |
| 8,862,039 | B2 * | 10/2014 | Yoshida et al. | 399/327 |
| 8,909,113 | B2 * | 12/2014 | Kawajiri | 399/327 |
| 2007/0048037 | A1 * | 3/2007 | Kakishima et al. | 399/324 |

FOREIGN PATENT DOCUMENTS

| | | | | |
|---|---|---|---|---|
| JP | 6-83230 | A | 3/1994 | |
| JP | 11237802 | A * | 8/1999 | G03G 15/20 |

OTHER PUBLICATIONS

Machine English Translation of JP11-237802 published Aug. 31, 1999.*

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes a toner image former; a fixing portion including a fixing roller and a pressing roller to fix the image; a feeder for reversing a facing orientation of the paper and refeed it to the image former; an executing portion for executing a cleaning mode in which a predetermined toner image is fixed on one side of paper, and the paper is refed to the image former with the reversed orientation to clean the pressing roller; a first integrator for integrating a number of the simplex mode executions; a notifying portion for prompting the cleaning mode operation upon a predetermined first integrated value; a second integrator for integrating a number of executions of a duplex mode in which toner images are formed on both sides of paper, wherein a corrector corrects the integrated value of the first integrator depending on the integrated value of the second integrator.

28 Claims, 8 Drawing Sheets

IMAGE FORMING APPARATUS WITH SIMPLEX AND DUPLEX OPERATIONS AND CLEANING MODE

FIELD OF THE INVENTION AND RELATED ART

The present invention relates to an image forming apparatus which forms an image on a sheet of recording paper with the use of a combination of toner, and an electrophotographic image forming method, an electrophotographic image recording method, or the like.

An electrophotographic image forming apparatus has a fixing apparatus (device) which fixes (thermally welds) a toner image on a sheet of recording paper to the sheet of recording paper by conveying the sheet of recording paper and the toner image thereon while pinching the sheet and the toner image thereon and applying heat and pressure to the sheet and the toner image thereon. As a fixing device such as the one described above which is employable by an image forming apparatus, a fixing device which is made up of a fixation roller as a rotational fixing member, and a pressure roller as a rotational pressure applying member to be pressed upon the fixation roller, has been widely used.

In a case where a sheet of paper which contains a large amount of $CaCO_3$ (calcium carbonate) which is used to make recording paper appear whiter is used as recording medium, particles of $CaCO_3$ tend to adhere to the fixation roller and/or pressure roller little by little. Therefore, if a large number of sheets of recording paper containing a large amount of $CaCO_3$ are conveyed through a fixing device, it is possible that a substantial amount of $CaCO_3$ will adhere to the fixation roller and/or pressure roller.

The $CaCO_3$ particles having adhered to the fixation roller transfer onto the next sheet of recording paper by way of the toner on the next sheet of recording paper, although the amount by which they transfer is minuscule. Because the amount by which $CaCO_3$ particles transfer is minuscule, they are unlikely to reduce the toner image on the next sheet of recording paper in quality. Thus, it does not occur that $CaCO_3$ particles continuously accumulate on a fixation roller.

However, while an electrophotographic image forming apparatus is operated in the one-sided printing mode (simplex mode), the pressure roller does not come into the toner on a sheet of recording paper, which functions as the intermediary which transfers $CaCO_3$ particles back onto a sheet of recording paper. Therefore, $CaCO_3$ particles gradually accumulate on the pressure roller. Eventually, the amount of $CaCO_3$ particles becomes substantial, that is, unignorable. On the other hand, in a case where an electrophotographic image forming apparatus is operated in the two-sided printing mode (duplex mode) while an unignorable amount of $CaCO_3$ particles is on the pressure roller, it is possible that the $CaCO_3$ particles on the pressure roller will adhere to the back surface (first image formation surface of sheet of recording paper used in two-sided printing mode) by a substantial (unignorable) amount, which in turn derogatorily affects the apparatus in image quality.

In order to deal with the above-described problems, the apparatus (device) disclosed in Japanese Laid-open Patent Application Hei 6-83230 carries out a cleaning sequence for removing the contaminants on its pressure roller. More concretely, it forms an image, which is specifically designed for cleaning, on a sheet of recording paper, and fixes the image. Then, it places the sheet of recording paper upside down, and conveys the sheet through the fixing device for the second time. Thus, the image for cleaning comes into contact with the pressure roller. As a result, the $CaCO_3$ particles having accumulated on the pressure roller transfer onto the cleaning image on the sheet of paper; they are removed from the pressure roller.

As for the conventional timing with which such a cleaning sequence as the one described above, as the number of single-sided prints formed by an electrophotographic image forming apparatus reaches a preset value, the sequence is automatically carried out, or the user of the apparatus is informed that the cleaning sequence needs to be carried out.

However, an electrophotographic image forming apparatus structured to carry out the cleaning sequence with the above-described timing suffers from the following problem:

That is, as the apparatus is operated in the two-sided printing mode, the $CaCO_3$ particles having accumulated on the pressure roller are reduced or eliminated because of the above-described mechanism. Therefore, carrying out the cleaning sequence based on the number of single-sided prints outputted by the apparatus may result in excessive cleaning of the pressure roller, which cannot be said to be desirable for the following reason. That is, while the cleaning sequence is carried out by the apparatus, the apparatus cannot be used by the user for a printing operation. In other words, structuring an electrophotographic image forming apparatus so that it automatically carries out the cleaning sequence for every preset number of single-sided prints unnecessarily increases the apparatus in downtime.

SUMMARY OF THE INVENTION

Thus, the primary object of the present invention is to provide an image forming apparatus which is capable of informing, with an optimal timing, a user (operator) that it needs to be operated in the cleaning mode for cleaning its pressure applying rotational member.

Another object of the present invention is to provide an image forming apparatus which is capable of automatically operating, with an optimal timing, in the cleaning mode for cleaning its pressure applying rotational member.

According to an aspect of the present invention, there is provided an image forming apparatus comprising a toner image forming portion configured to form a toner image on recording paper; a fixing portion including a fixing rotatable member and a pressing rotatable member to fix the toner image on the recording paper while nipping and feeding the recording paper carrying the toner image formed by said toner image forming portion; a feeding portion configured and positioned to reverse a facing orientation of the recording paper on which the toner image is fixed by said fixing device and refeed the recording paper to said toner image forming portion and said fixing device; an executing portion configured to execute an operation in a cleaning mode in which a predetermined toner image is formed and fixed on one side of recording paper by said toner image forming portion and said fixing portion, and thereafter, the recording paper being refed by said feeding means to said toner image forming portion and then to said fixing portion with the reversed facing orientation, so that said pressing rotatable member is cleaned; a first integrating portion configured to integrate a number of the executions of the operations of the simplex mode only on the one side of the recording paper; a notifying portion configured to notify for promoting execution of the cleaning mode when the integrated value of said first integration is not less than a predetermined value; a second integrating portion configured to integrate a number of executions of operations of a duplex mode in which toner images are formed on both sides of recording paper; and a correcting portion configured to correct the integrated value of said first integrating portion in accordance with the integrated value of said second integrating portion.

According to another aspect of the present invention, there is provided an image forming apparatus comprising a toner image forming portion configured to form a toner image on recording paper; a fixing portion including a fixing rotatable member and a pressing rotatable member to fix the toner image on the recording paper while nipping and feeding the recording paper carrying the toner image formed by said toner image forming portion; a feeding portion configured and positioned to reverse a facing orientation of the recording paper on which the toner image is fixed by said fixing device and refeed the recording paper to said toner image forming portion and said fixing device; a first integrating portion configured to integrate a number of the executions of the operations of the simplex mode only on the one side of the recording paper; an executing portion configured to execute, when the integrated value of said first integrating portion is not less than a predetermined value, an operation in a cleaning mode in which a predetermined toner image is formed and fixed on one side of recording paper by said toner image forming portion and said fixing portion, and thereafter, the recording paper being refed by said feeding means to said toner image forming portion and then to said fixing portion with the reversed facing orientation, so that said pressing rotatable member is cleaned; a second integrating portion configured to integrate a number of executions of operations of a duplex mode in which toner images are formed on both sides of recording paper; and a resetting portion configured to reset the integrated value of said first integrating portion when the integrated value of said second integrating portion reaches a predetermined value.

Further features of the present invention will become apparent from the following description of exemplary embodiments (with reference to the attached drawings).

DESCRIPTION OF THE PREFERRED EMBODIMENTS

Hereinafter, the present invention is described in detail with reference to image forming apparatuses which are in accordance with the present invention.

(Embodiment 1)

1. General Structure and Operation of Image Forming Apparatus

Figure 1:
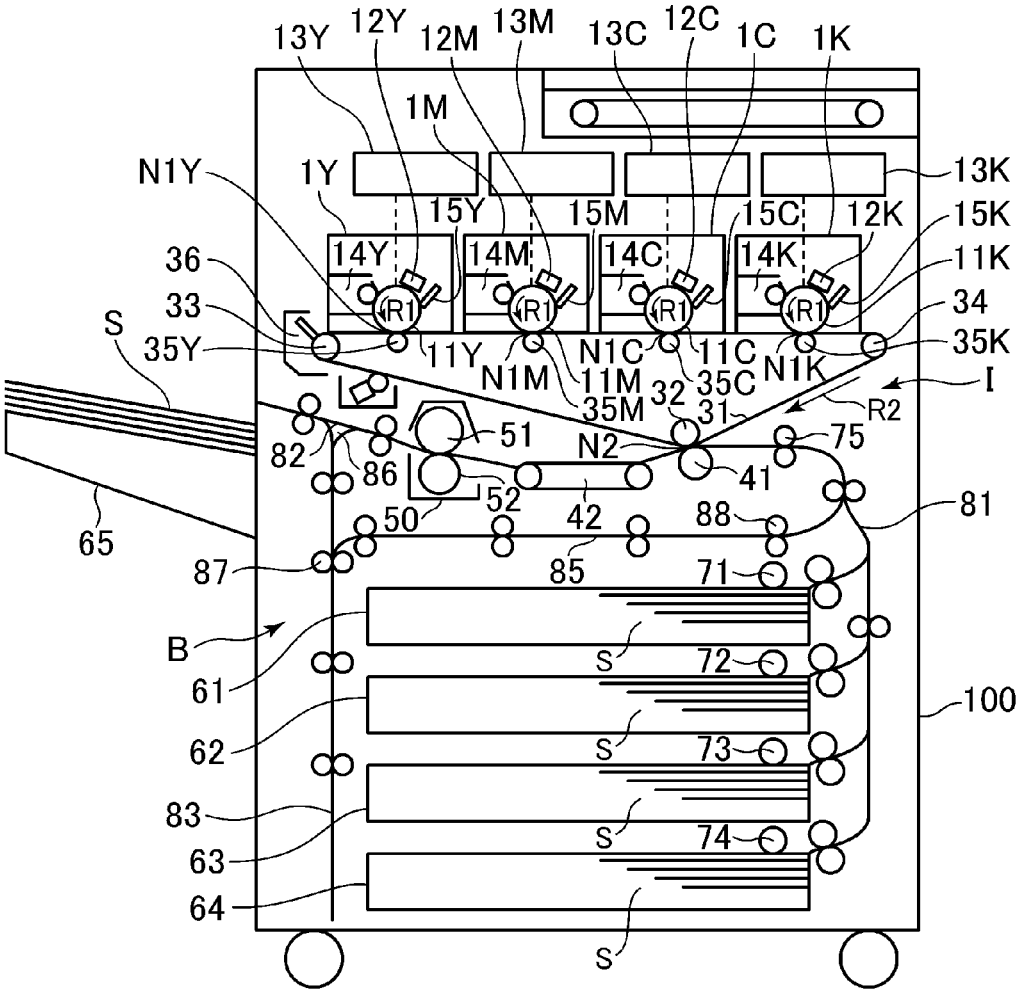
FIG. 1 is a schematic sectional view of a typical image forming apparatus to which the present invention is applicable.

FIG. 1 is a schematic sectional view of the image forming apparatus 100 in this embodiment of the present invention. This image forming apparatus 100 uses an electrophotographic image forming method, and can form a full-color image on a sheet S of recording paper (recording medium) in response to the image formation signals transmitted thereto from an external device. It is of the so-called intermediary transfer type, and also, of the so-called tandem type.

The image forming apparatus 100 has image formation stations 1Y, 1M, 1C and 1K, and an intermediary transferring member (intermediary transfer belt, hereafter) 31. The image formation stations 1Y, 1M, 1C and 1K are the toner image forming portions of the apparatus 100. They form a toner image on a sheet of recording paper. They are aligned in parallel along the horizontal portion of the intermediary transfer belt 31, in the direction in which the horizontal portion of the intermediary transfer belt 31 moves.

In this embodiment, the image formation stations 1Y, 1M, 1C and 1K are practically the same in structure and operation, although they are different in the color of the toner they use. Thus, unless they need to be differentiated, their components will be described together, without showing the suffixes Y, M, C and K which indicate the color of the image they form.

The image formation station 1 has a photosensitive drum 11, as an image bearing member, which is an electrophotographic photosensitive member (photosensitive member) and is in the form of a drum. The photosensitive drum 11 is rotationally driven in the direction indicated by an arrow mark R1 in the drawing. The image formation station 1 has also the following processing means, more specifically, a charge roller 12, an exposing device 13, a developing device 14, a primary transfer roller 35, and a cleaning device 15, which are disposed in the adjacencies of the peripheral surface of the photosensitive drum 11, in the listed order in terms of the rotational direction of the photosensitive drum 11. The first one is the charge roller 12 as a charging means for uniformly charging the photosensitive drum 11. It is a charging member which is in the form of a roller. The next one is the exposing device 13 as an exposing means for forming an electrostatic latent image (electrostatic image) on the photosensitive drum 11 by projecting a beam of light upon the photosensitive drum 11 while modulating the beam of light with the image formation signals. The third one is the developing device 14 as a developing means which forms a toner image, on the photosensitive drum 11, by transferring toner onto the electrostatic latent image on the photosensitive drum 11. The next one is the primary transfer roller 35 as the primary transferring means for transferring the toner image on the photosensitive drum 11, onto the intermediary transfer belt 31 (primary transfer). It is a transferring member which is in the form of a roller. The last one is the cleaning device 15 as a cleaning means which removes the toner (primary transfer residual toner) remaining on the photosensitive drum 11 after the primary transfer, and stores the removed transfer residual toner.

The intermediary transfer belt 31 is an endless belt formed of film. It is suspended and kept stretched by multiple members, more specifically, a driver roller 33, a tension roller 34, and a secondary transfer roller opposing roller 32. The intermediary transfer belt 31 is circularly driven by the driver roller 33 in the direction indicated by an arrow mark R2 in the drawing. The image forming apparatus 100 is provided with four primary transfer rollers 35Y, 35M, 35C and 35K, which are disposed on the inward side of the loop (belt loop) which the intermediary transfer belt 31 forms, being positioned so that they oppose the photosensitive drums 11Y, 11M, 11C and 11K, respectively. Each primary transfer roller 35 is pressed upon the corresponding photosensitive drum 11 with the presence of the intermediary transfer belt 31 between itself and photosensitive drum 11, forming the primary transfer area (primary transfer nip) N1, which is the area of contact between the intermediary transfer belt 31 and photosensitive drum 11. The image forming apparatus 100 has also a secondary transfer roller 41 as the secondary transferring means which is disposed on the outward side of the belt loop, being positioned so that it opposes the secondary transfer roller opposing roller 32. The secondary transfer roller 41 is in the form of a roller, and is kept pressed against the secondary transfer roller opposing roller 31, with the presence of the intermediary transfer belt 31 between itself and secondary transfer roller opposing roller 32. Further, there is disposed a belt cleaning device 36 as an intermediary transferring member cleaning means, which removes the toner (secondary transfer residual toner) remaining on the intermediary transfer belt 31 after the secondary transfer, and recovers the removed secondary transfer residual toner. The belt cleaning device 36 is positioned on the opposite side of the intermediary transfer belt 31 from the driver roller 33.

When the image forming apparatus 100 is in the full-color mode, for example, yellow, magenta, cyan and black monochromatic toner images are formed on the photosensitive drums 11Y, 11M, 11C and 11K of the image formation stations 1Y, 1M, 1C and 1K, respectively. Then, the four monochromatic toner images, different in color, on the photosensitive drums 11Y, 11M, 11C and 11K are transferred in layers onto the intermediary transfer belt 31 (primary transfer), in the primary transfer areas (nips) N1 of the image formation stations 1Y, 1M, 1C and 1K, respectively.

Meanwhile, a sheet S of recording paper (recording medium) in one of multiple recording paper cassettes 61, 62, 63 and 64 as recording medium storage, is conveyed into the recording medium conveyance passage 81, by the rotation of recording medium supplying rollers 71, 72, 73 or 74. Then, the sheet S of recording paper is conveyed further by a pair of registration rollers 75 to the secondary transfer area (nip) N2, with the same timing as the timing with which the layered toner images on the intermediary transfer belt 31 arrive at the secondary transfer area N2.

Then, in the secondary transfer area N2, the layered toner images on the intermediary transfer belt 31 are transferred together (secondary transfer) onto the sheet S of recording paper.

In this embodiment, the various components of the image formation station 1, intermediary transfer belt 31, and secondary transfer roller 41 make up the toner image formation station 1 for forming a toner image on a sheet S of recording paper.

After the transfer of the layered toner images onto the sheet S of recording paper, the sheet S is conveyed by the conveyer belt 42 to a fixing device 50 as the image fixing portion of the image forming apparatus 100. The fixing device 50 has a pair of rotational members, more specifically, a fixation belt 51 as a rotational fixing member, and a pressure roller 52 as a rotational pressure applying member. The fixation belt 51 generates heat in itself by electromagnetic induction. The fixing device 50 conveys the sheet S through itself while keeping the sheet S pinched between its fixation belt 51 and pressure roller 52 and applying heat and pressure to the layered toner images on the sheet S. Consequently, the layered toner images on the sheet S are welded (fixed) to the sheet S. The fixing device 50 will be described later in detail.

After the fixation of the layered toner images to the sheet S of recording paper, the sheet S is discharged from the main assembly of the image forming apparatus 100 onto the delivery tray 65, through the recording medium discharge passage 82.

Incidentally, the image forming apparatus 100 in this embodiment is capable of operating in the one-sided printing mode, in which a toner image is fixed to only one of the two surfaces of the sheet S of recording paper. It is also capable of operating in the two-sided printing mode, in which a toner image is fixed to both surfaces of the sheet S. In the two-sided printing mode, after a toner image is fixed to one of the two surfaces of the sheet S of recording paper, another toner image is fixed to the second surface of the sheet S before the sheet S is discharged from the image forming apparatus 100. Therefore, the image forming apparatus 100 is provided with a recording medium conveying means B for the two-sided printing mode, which turns over the sheet S of recording paper after the fixation of a toner image to one of the two surfaces of the sheet S by the fixing device 50, and sends the sheet S to the toner image formation station 1 for the second time. In this embodiment, the recording medium conveying means B for the two-sided printing mode is made up of a sheet reversing passage 83, a two-sided printing mode sheet passage 85, a pair of switchback rollers 87, a pair of two-sided printing mode sheet conveyance rollers, etc.

In the one-sided printing mode, after the fixation of a toner image to one of the two surfaces of the sheet S of recording paper, the sheet S is discharged from the fixing device 50, is directed toward the sheet discharge passage 85 by a flapper 86, and then, is discharged into the delivery tray 65.

In the two-sided printing mode, the sheet S of recording paper is discharged from the fixing device 50 after the fixation of a toner image to one of the two surfaces of the sheet S. Then, the sheet S is directed toward the two-sided printing mode sheet conveyance passage 85, and then, is reversed in a conveyance direction by the pair of switchback rollers 87. Then, it is sent into the two-sided printing mode sheet passage 85. Then, the sheet S is conveyed to the second transfer area (image transfer area) N2, being positioned so that its second surface faces the intermediary transfer belt 31. After the fixation of a toner image to the second surface of the sheet S, the sheet S is sent to the fixing device 50 for the second time, so that the toner image on its second surface is fixed to the sheet S. After the fixation of the toner image to the second surface of the sheet S, that is, after the fixation of two toner images to the both surfaces of the sheet S, one for one, the sheet S is discharged from the fixing device 50, is directed by the flapper 86 toward the sheet discharge passage 85, and is discharged into the delivery tray 65.

2. Control of Image Forming Apparatus

Figure 2:
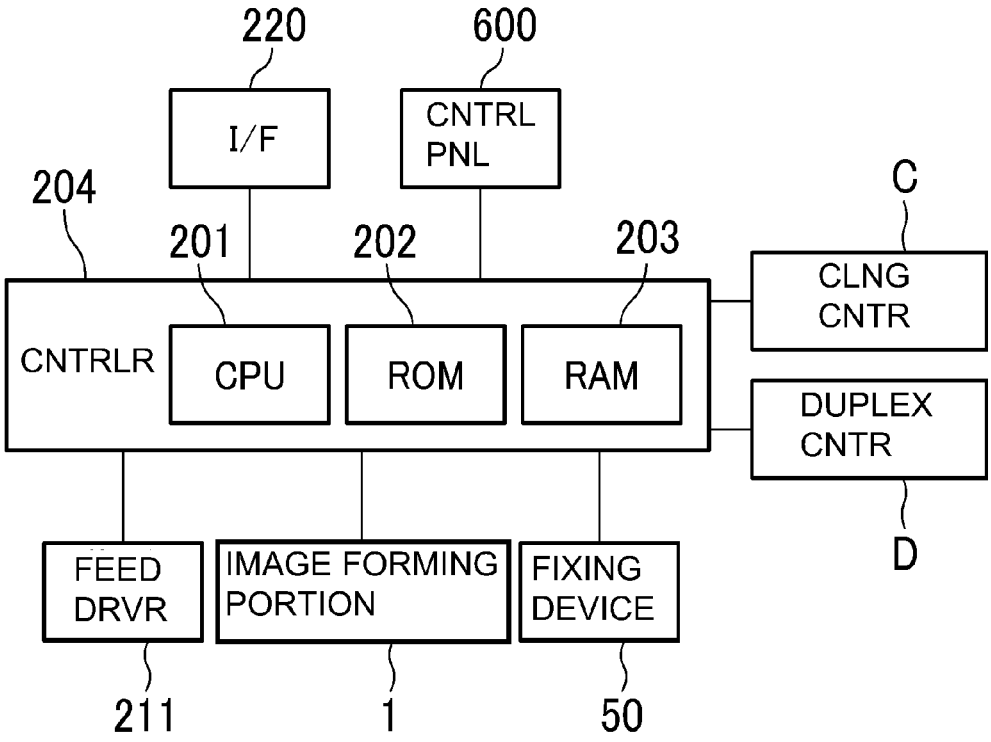
FIG. 2 is a block diagram of the essential portions of the image forming apparatus, and shows the relationship among the essential portions in terms of their control.

FIG. 2 is a block diagram of the essential portions of the image forming apparatus 100 in this embodiment. It shows the relationship among the essential portions in terms of their control.

The image forming apparatus 100 has a control section 204 which integrally controls the operations of various portions of the image forming apparatus 100. The control section 204 has a CPU 201 as a controlling means (controller) for integrally controlling the operations carried out by various portions of the image forming apparatus 100. Further, the control section 204 has a ROM 202 as a storing means in which the programs for operating the CPU 201 are stored. It has also a RAM 203 as a storing means which the CPU 2021 uses to temporarily store the data. The control section (CPU circuit portion) 204 is an integral combination of the CPU 201, ROM 202, and RAM 203.

A conveying means driving section 211 drives motors, clutches, solenoids, etc., for supplying the main assembly of the image forming apparatus 100 with a sheet of recording paper, and conveying sheets S through the main assembly, in response to the control signals from the CPU 201. The image formation station 1 electrophotographically forms a toner image on the sheet S of recording paper, based on the image formation data transmitted thereto from the external I/F 220 (which will be described later), in response to the control signals transmitted thereto from the CPU 201. The external I/F section 220 transmits the image data inputted from the external apparatus such as a scanner (image reading apparatus) and a PC (personal computer), to the CPU 201. The control panel 600 functions as the means through which the image forming apparatus 100 receives a print job (image formation sequence for forming the image on single or multiple sheets of recording paper in response to an image formation start instruction), and informs an operator of the state of the image forming apparatus 100 in response to the control signals from the CPU 201.

In this embodiment, the CPU 201 functions as the means which sets the timing with which the rotational member of the fixing device 50 to be cleaned, as will be described later in detail. It also functions as the means which makes the cleaning device carry out the cleaning operation for cleaning the rotational member of the fixing device 50. Further, the CPU 201 functions also as the section for adjusting the timing with which the image forming apparatus 100 (fixing device 50) is operated in the cleaning mode, which will be described later.

Also in this embodiment, the control panel 600 functions as the instructing means (informing section) for informing an operator of the timing with which the rotational member of the fixing device 50 is to be cleaned, and also, as an executing means which makes the image forming apparatus 100 clean the rotational member of the fixing device 50 (means which makes the image forming apparatus operate in cleaning mode).

3. Control Panel

Figure 3:
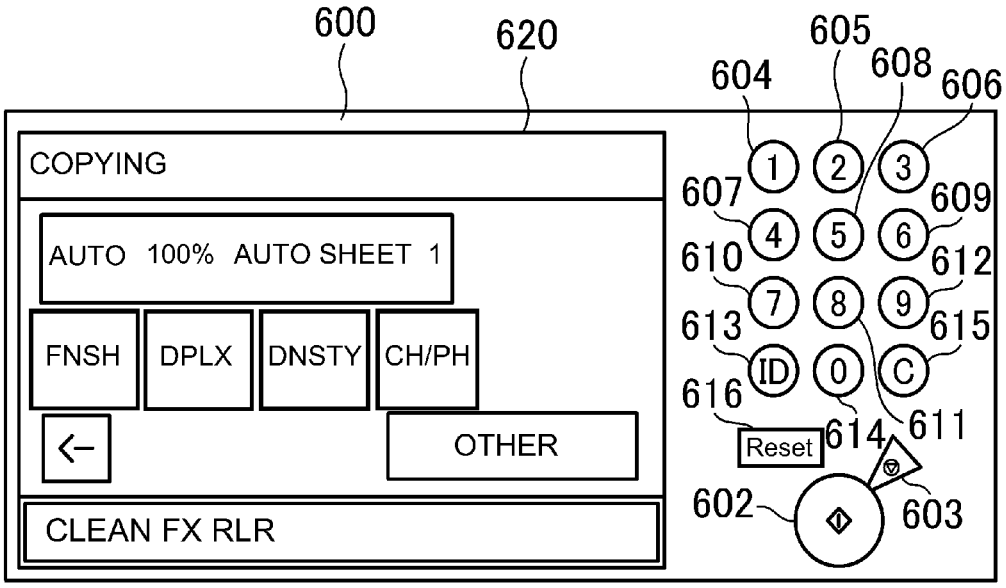
FIG. 3 is a schematic drawing of the control panel of the image forming apparatus.

FIG. 3 is a schematic drawing of the control panel 600 of the image forming apparatus 100 in this embodiment.

The control panel 600 is provided with a start key 602 for making the image forming apparatus 100 start an image forming operation, a stop key for making the image forming apparatus 100 interrupt an on-going image forming operation, etc. It is also provided with numerical keys 604-612 and 614 for inputting numerical values, an ID key 613, a clear key 615, a reset key 616, etc. Further, the control panel 600 is provided with a display 620, which functions as a touch panel, and across which soft keys or the like can be formed.

Further, the control panel 600 is provided an area for informing an operator of the state of the image forming apparatus 100, which corresponds in position to the bottom area of the drawing of the display 620 in FIG. 3. For example, if it is determined by the CPU 201 that the pressure roller 52 needs cleaning, a message which prompts the operator to clean the pressure roller 52 is displayed at the bottom of the display 620, in response to the control signals from the CPU 201, as will be described later in detail. Further, this control panel 600 functions also as a means for informing the operator of the information that the cumulative value in the first cumulating means exceeded a preset value, and therefore, the fixing device 50 needs to be operated in the cleaning mode.

4. Fixing Device

Figure 4:
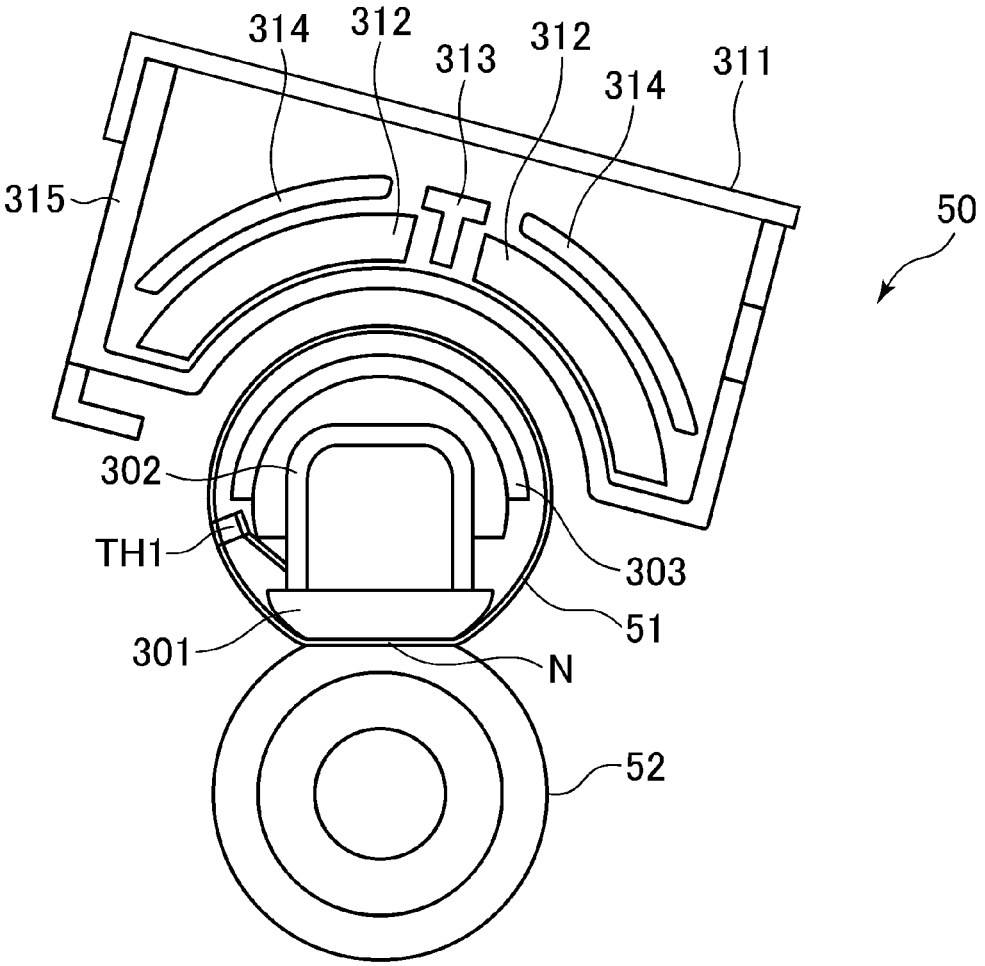
FIG. 4 is a schematic sectional view of the fixing device in the first embodiment of the present invention.

FIG. 4 is a schematic sectional view of the fixing device 50 of the image forming apparatus 100 in this embodiment.

The fixing device 50 has the fixation belt 51 as a rotational fixing member (rotational heating member) which is in the form of an endless belt having a metallic layer. It has also the pressure roller 52 as a rotational pressure applying member, which is disposed so that its peripheral surface contacts the peripheral surface of the fixation belt 51. The fixation belt 51 is one of the pair of rotational members of the fixing device 50, with which an unfixed toner image comes into contact. The pressure roller 52 is the other of the pair of rotational members of the fixing device 50.

The fixing device 50 has a pressure applying member 301, against which the pressure roller 52 is pressed, with the presence of the fixation belt 51 between itself and pressure roller 52, to form a fixation nip N between the fixation belt 51 and pressure roller 52. The pressure applying member 301 is disposed on the inward side of the loop which the fixation belt 51 forms. It is held to a metallic stay 302. Further, the fixing device 50 has a magnetism blocking core 305 as a magnetism blocking member for preventing the stay 302 and pressure applying member 301 from being increased in temperature by the heat generated therein by magnetic induction. The magnetism blocking member 305 is disposed on the excitation coil side (which will be described layer) of the stay 302.

Further, the fixing device 50 has a heating device 311 as a heat source (inductive heating means) for heating the fixation belt 51 based on electromagnetic induction. The inductive heating device 311 has an excitation coil 312 made up of electric wire, for example, Litz wire, wound in the shape of the bottom portion of a long and narrow boat, so that it conforms in shape to the portion of the fixation belt 51, which corresponds in position to the top and side portions of the loop which the fixation belt 51 forms. The inductive heating device 311 has a pair of external magnetic cores 313 and 314, which are shaped so that they cover the excitation coil 312 to make it virtually impossible for the magnetic field generated by the excitation coil 312 to leak, except toward the metallic layer (electrically conductive layer) of the fixation belt 51. Further, the inductive heating device 311 has a coil holding member 315 which holds the excitation coil 312 and external magnetic cores 313 and 314, with the use of electrically insulating resin. The inductive heating device 311 is disposed on the top side of the outward surface of the fixation belt 51, with reference to FIG. 4, being positioned in such an attitude that a preset amount of gap is provided between the outward surface of the fixation belt 51 and inductive heating device 311. To the excitation coil 312 of the inductive heating device 311, high frequency electric current, the frequency of which is in a range of 20-60 kHz, is applied while the fixation belt 51 is rotated. Thus, the metallic layer (electrically conductive layer) of the fixation belt 51 is inductively heated by the magnetic field generated by the excitation coil 312.

Further, the fixing device 50 is provided with a temperature sensor (temperature detection element) TH1, such as a thermistor, which is disposed on the inward side of the loop which the fixation belt 51 forms. In terms of the widthwise direction (direction parallel to rotational axis), the temperature sensor TH1 positioned at the center of the fixation belt 51, in contact with the inward surface of the fixation belt 51. Also in terms of the widthwise direction of the fixation belt 51, the temperature sensor TH1 detects the temperature of the fixation belt 51, within the area in which the fixation belt 51 can contact the sheet S of recording paper. The information regarding the detected temperature of the fixation belt 51 is fed back to the CPU 201 which functions as the fixation controlling section. The CPU 201 controls the electrical power to be inputted into the excitation coil 312, so that the detected temperature of the fixation belt 51, which is inputted into the CPU 201, remains a preset target level (fixation temperature). That is, as the detected temperature of the fixation belt 51 rises to the preset level, the electric power supply to the excitation coil 312 is stopped. In this embodiment, in order to keep the temperature of the fixation belt 51 stable at 180° C., or the target level, the electric power to be inputted into the excitation coil 312 is controlled. More specifically, the high frequency electric current to be inputted into the excitation coil 12 is changed in frequency in response to the value of the temperature of the fixation belt 51 detected by the temperature sensor TH1.

5. Cleaning Operation

Next, the operation (cleaning mode) for cleaning one of the rotational members of the fixing device 50 in this embodiment is described. In this embodiment, the cleaning operation is carried out to clean the pressure roller 52, which is one of the rotational members of the fixing device 50. It is positioned so that when a sheet S of recording paper is conveyed through the fixing device 50, it will be on the opposite side of the sheet S from the surface of the sheet S, with which a toner image comes into contact before its fixation.

For example, in a case where the image forming apparatus 100 is operated in the one-sided printing mode to output a large number of prints (one-sided prints) using sheets of recording paper which are substantial in the amount of $CaCO_3$ contents, particles of $CaCO_3$ sometimes adhere to the pressure roller 52. It also occurs sometimes that the pressure roller 52 is contaminated by the toner particles which have failed to be completely welded to the sheet S of recording paper, and therefore, are remaining on the fixation belt 51. In a case where the image forming apparatus 100 is operated in the two-sided printing mode, the pressure roller 52 comes into contact with the fixed toner image on the surface of the sheet S, on which a toner image was fixed first. Thus, when the unfixed toner image on the second surface is fixed, the fixed toner image on the first surface of the sheet S is sometimes soiled.

In order to prevent the occurrence of this phenomenon, the image forming apparatus 100 in this embodiment is enabled to carry out the operation for cleaning the peripheral surface of the pressure roller 52 as necessary.

Roughly describing, in the cleaning operation, a predetermined toner image is formed on one of the two surfaces of the sheet S of recording paper by the toner image forming means I, and the formed toner image is fixed to the sheet S by the fixing device 50. Then, the sheet S is placed upside down by the two-sided printing mode sheet conveying means B, and is conveyed through the fixing device 50 for the second time. Thus, the pressure roller 52 as a rotational member which is on the opposite side of the sheet S from the surface of the sheet S, with which the unfixed toner image comes into contact, is cleaned by the fixed toner image on the first surface of the sheet S. More concretely, in the cleaning operation in this embodiment, a solid image which matches the sheet S of recording paper in size is formed on one (first) of the two surfaces of the sheet S of recording paper, and is fixed to the first surface. Then, the sheet S is placed upside down, and conveyed through the fixing device 50, to transfer the contaminative toner and $CaCO_3$ particles, etc., having adhered to the pressure roller 52, onto the sheet S.

More specifically, the aforementioned solid image means such an image which can cover the entirety of the image formation area (range) of the sheet S of recording paper and is preset in density (highest density level, typically).

Incidentally, in this embodiment, the cleaning operation is carried out by the image forming apparatus 100 as an operator gives the image forming apparatus 100 (control section 204) a command for starting the cleaning operation.

Figure 5:
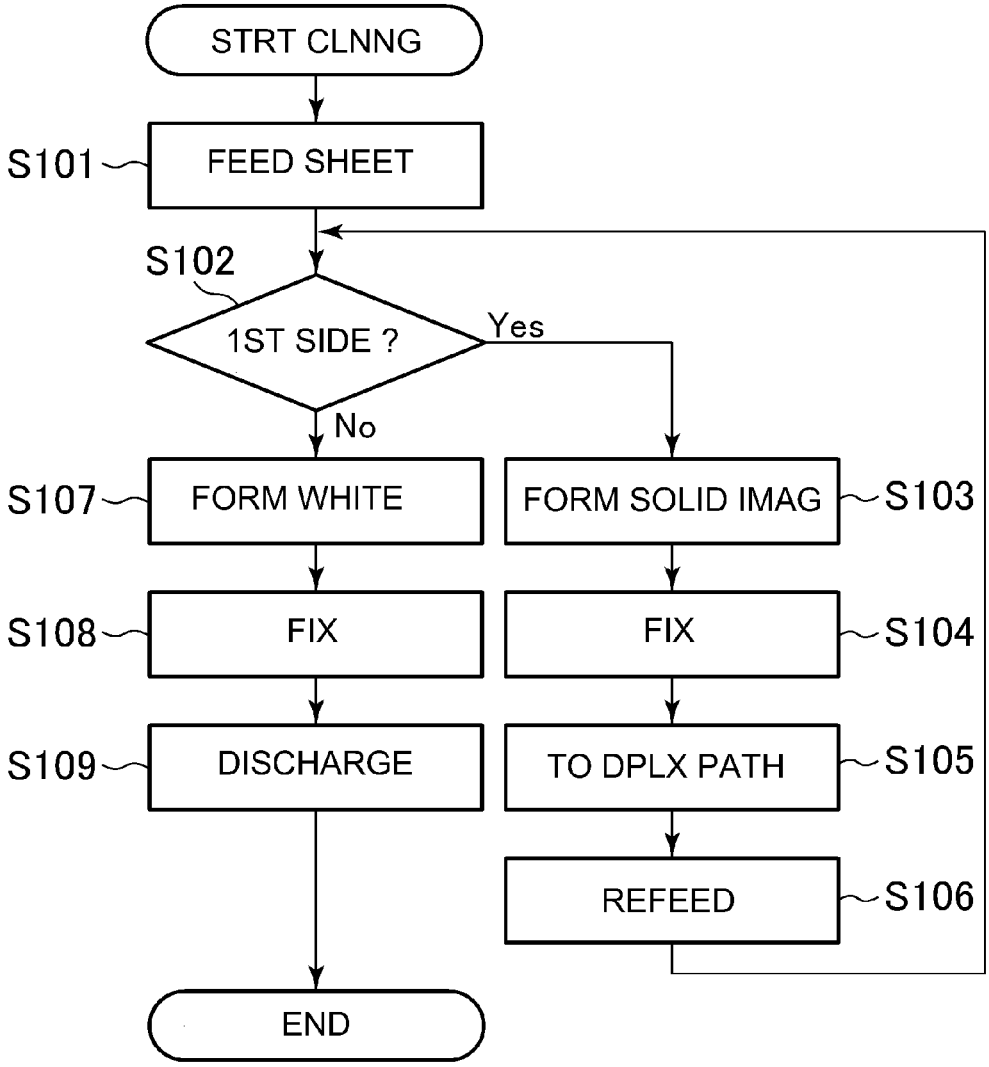
FIG. 5 is a flowchart of the cleaning operation for cleaning the pressure roller.

FIG. 5 is a flowchart of the cleaning operation for cleaning the pressure roller 52. It is for describing the steps which the image forming apparatus 100 is made to carry out by the CPU 201.

As the cleaning operation is started, the CPU 201 controls the recording medium conveying means driving section 211 to feed a sheet S of recording paper as a cleaning sheet into the main assembly of the image forming apparatus 100 (S101). Then, the sheet S is conveyed to the secondary transfer area (image transfer section) N2 through the recording medium conveyance passage 81.

Next, the CPU 201 decides whether it is the first time an image is formed on the sheet S of recording paper or not (S102).

If the CPU 201 determines in Step S102 that it is the first time an image is formed on the sheet S, it controls the image formation station 1 to form a solid image for cleaning, on sheet S (S103).

In this embodiment, this solid image for cleaning is formed of yellow and cyan color toners, because a solid toner image formed of two color toners is greater in the amount of toner per unit area than a solid toner image formed of only one toner. The greater the solid image for cleaning, in the amount of toner per unit area, the better the solid image in cleaning performance. Therefore, it is desired that the solid image is formed of the yellow and cyan toners. Further, the solid image formed of the yellow and cyan toners makes more conspicuous the contaminants (toner and the like) having adhered to the solid image, being advantageous in that it makes it easier to see the cleaning effects of the solid image. Thus, the toner image to be formed for the cleaning operation for cleaning the rotational member(s) of the fixing means is desired to be such a solid image that is formed of two or more color toners.

In order to ensure that the entirety of the peripheral surface of the pressure roller 52 is cleaned, the sheet S of recording paper which is to be used as the recording medium on which the solid image for cleaning is formed is desired to be a sheet of recording paper, the dimension of which in terms of the recording medium conveyance direction is greater than the circumference of the pressure roller 52. That is, the solid toner image for cleaning is desired to be such that its dimension in terms of the recording medium conveyance direction is greater than the circumference of the rotational member, which is on the opposite side of the sheet S from the surface of the sheet S, with which the solid toner image for cleaning comes into contact before it is fixed. Further, the sheet S of recording paper which is to be used as the recording medium on which the solid image for cleaning is formed is desired to be such a sheet of recording paper that in terms of the direction which is roughly perpendicular to the recording medium conveyance direction, its dimension is greater than the dimension of the largest image which the image forming apparatus 100 can form. Therefore, it is desired that a sheet S of recording paper which is largest in dimension in terms of the direction which is roughly perpendicular to the recording medium conveyance direction, that is, the longest sheet S of recording paper among the sheets S of recording medium conveyable through the fixing device 50, is used as the sheet S of recording paper used for cleaning. With the use of such a sheet of recording paper as the sheet S of recording paper for cleaning, the problem that the image on the second surface of the sheet S of recording paper is soiled by the contaminants such as the $CaCO_3$ particles can be prevented regardless of the size of the image on the surface of the sheet S on which an image is formed first when the image forming apparatus 100 is in the two-sided printing mode. In this embodiment, the dimension of the sheet S of recording paper for cleaning, in terms of the recording medium conveyance direction, and that in terms of the direction which is roughly perpendicular to the recording medium conveyance direction, are set to the values in the above-described range.

Next, the CPU 201 controls the fixing device 50 to make the fixing device 50 fix the solid image for cleaning, to the sheet S of recording paper (S104).

Then, the CPU 201 controls the recording medium conveying means driving section 211 so that the sheet S of recording to which the solid image for cleaning has just been fixed, into the recording medium reversing passage 83, and changes the sheet S in direction to send the sheet S into the recording medium conveyance passage 83 for the two-sided printing mode (S105). Thus, the sheet S is placed upside down.

Next, the CPU 201 controls the recording medium conveying means driving section 211 to feed the sheet S of recording paper, which is bearing the fixed solid image for cleaning, into the secondary transfer area (nip) N2 for the second time (S106). Then, the CPU 201 returns to Step S102.

If the CPU 201 determines in Step S102 that the next image to be formed on the sheet S of recording paper is not the first image to be formed on the sheet S, that is, if it determines that the next image to be formed is the second image to be formed on the sheet S of recording paper, the CPU 201 controls the image formation station 1 to form a solid white image (S107). That is, no image is formed on the second surface of the sheet S.

Next, the CPU 201 controls the fixing device 50 to fix the "white" image to the sheet S (S108). That is, the CPU 201 controls the fixing device 50 so that the sheet S is conveyed through the fixing device 50 in such an attitude that the surface (first surface) which is bearing the fixed solid image for cleaning faces the pressure roller 52, and the surface (second surface) on which no toner image was formed faces the fixation belt 51. While the sheet S is conveyed through the fixing device 50, the fixed solid image on the first surface of the sheet S is melted again. That is, the melted solid image for cleaning comes into contact with the pressure roller 52. Thus, the contaminative toner, $CaCO_3$ particles, and the like contaminants having adhered to the peripheral surface of the pressure roller 52 are adhered to the melted toner (toner image) on the sheet S, being thereby transferred onto the sheet S. In other words, the peripheral surface of the pressure roller 52 is cleaned by the cleaning sheet S, that is, the sheet S of recording paper having the solid image form cleaning.

Incidentally, in this embodiment, the temperature of the fixing device 50 is kept at 180° C., or the target level, as described above, either while the sheet S of recording paper for cleaning is conveyed through the fixing device 50 for the first time (fixation on first surface), or for the second time (fixation on second surface).

Lastly, the CPU 201 controls the recording medium conveying means driving section 211 to conveys the sheet S for cleaning to the sheet discharge passage 82 and discharge the sheet S into the delivery tray 65 (S109).

6. Setting of Cleaning Timing

Next, the means, in this embodiment, which decides whether or not the pressure roller 52 needs to be cleaned, is described.

The primary object of the present invention is to provide an image forming apparatus which is simpler in structure, and yet, can easily determine the timing with which the rotational member of its fixing means to be cleaned, than any image forming apparatus in accordance with the prior art. To describe the object in further detail, it is to provide an image forming apparatus which does not require a sensor such as an optical sensor dedicated to the operation for deciding whether or not its pressure roller 52 needs to be cleaned, being therefore lower in cost, and smaller in size, and yet, can prevent the image contamination attributable to the contamination of the pressure roller 52, as effectively as, or more effectively, than any image forming apparatus in accordance with the prior art.

The contaminative toner and $CaCO_3$ particles, which is on the peripheral surface of the pressure roller 52, are removed little by little while the image forming apparatus 100 is operated in the two-sided printing mode, because the contaminative toner and $CaCO_3$ particles transfer onto the toner image on the first surface of the sheet S of recording paper, by a minute amount, and are discharged with the sheet S, each time the sheet S is conveyed through the fixing device for the second time in the two-sided printing mode. Therefore, it is reasonable to think that after a certain number of two-sided prints are outputted by the image forming apparatus 100, the pressure roller 52 is clean, and therefore, does not need to be cleaned. However, it is also reasonable to think that in a case where a certain number of one-sided prints are outputted by the image forming apparatus 100, without being interrupted by an image forming operation for outputting two-sided prints, a substantial amount of the contaminative toner and $CaCO_3$ particles will have accumulated on the peripheral surface of the pressure roller 52, and therefore, it will be necessary for the pressure roller 52 to be cleaned.

In the case of the image forming apparatus 100 in this embodiment, therefore, it is provided with each of the following means. The first one is the first accumulating means for accumulating the information related to the number by which one-sided prints are outputted by the image forming apparatus 100. The second means is the second accumulating means for accumulating the information related to the number of the two-sided prints outputted by the image forming apparatus 100. The third is an altering means which reduces the value in the first accumulating means as the value in the second accumulating means reaches a preset value. The fourth is an informing means which informs an operator (user) of the timing with the pressure roller 52 is to be cleaned, that is, as the value in the first accumulating means exceeds the preset value. In particular, in this embodiment, the above-described altering means functions also as a resetting means for resetting the value in the first accumulating means as the number of prints outputted by the image forming apparatus 100 in the two-sided printing mode reaches the preset value.

The typical information related to the amount by which the image forming apparatus 100 is operated in the one-sided printing mode is the information related to the number of the sheets S of recording paper discharged from the image forming apparatus 100 in the one-sided printing mode. However, it does not need to be limited to this information. That is, all that is necessary is that the information is related to the amount by which the image forming apparatus 100 is operated in the one-sided printing mode. For example, it may be the number of times one of the rotational members of the fixing device 50 is rotated in a given image forming operation carried out in the one-sided printing mode. This is true with the information related to the amount by which the image forming apparatus 100 is operated in the two-sided printing mode. As for the altering means, it clears the first accumulating means as the value in the second accumulating means exceeds the preset value, as will be described later in detail. However, this embodiment is not intended to limit the present invention in scope. For example, the image forming apparatus 100 may be designed so that the value in the first accumulating means is reduced by a preset amount in proportion to the degree by which the rotational member is cleaned by the image forming operation carried out in the two-sided printing mode.

To describe in further detail, the image forming apparatus 100 in this embodiment is provided with a cleaning counter (one-sided print counter) C, as the first accumulating means, which is a storing means and cumulatively counts the number of one-sided prints (FIG. 2). Further, the image forming apparatus 100 is provided with a two-sided print counter D, as the second accumulating means which is a storing means and cumulatively counts the number of the two-sided prints (FIG. 2). As the value in the cleaning counter exceeds a preset value, the CPU 201, as the prompting means, determines that the rotational member needs to be cleaned. Then, it outputs a signal that informs an operator of the timing with which the rotational member is to be cleaned. Further, as the value in the two-sided print counter D exceeds the preset value, the CPU 201 as the prompting means clears the cleaning counter C.

Here, it is desired that the second accumulating means accumulates the information related to the amount by which the image forming apparatus 100 is operated in the two-sided printing mode, based on the sum of all the sheets S of recording paper, in terms of their dimension in the recording medium conveyance direction, outputted by the image forming apparatus 100 in the two-sided printing mode. Thus, it is desired that the image forming apparatus 100 is provided with a means for obtaining the information related to the dimension of each sheets S of recording medium in terms of the direction in which the sheet S is conveyed. Further, it is desired that the value to be added to the value in the second accumulating means each time a two-sided print is outputted by the image forming apparatus 100, is set based on the information related to the dimension of the sheet S of recording paper used to output the two-sided print, in terms of the recording medium conveyance direction, obtained by the recording medium dimension obtaining means.

For example, in a case where the dimension, in terms of the recording medium conveyance direction, of the sheet S of recording paper to be used for a two-sided print is greater than 215.9 mm, its effectiveness in terms of the removal of the contaminative toner and $CaCO_3$ particles on the peripheral surface of the pressure roller 52 is equivalent to twice that of the sheet S of recording paper to be used for the two-sided print, which is no more than 215.9 mm. In this embodiment, therefore, in a case where the sheet S of recording paper to be used to output a two-sided print is greater in dimension than 215.9 mm in terms of the recording medium conveyance direction, 2 is added to the value in the two-sided print counter D.

However, this embodiment is not intended to limit the present invention in terms of the method for counting the prints outputted from the image forming apparatus 100. That is, the method may be such that the print count is weighted in proportion to the length of each print. That is, the image forming apparatus 100 may be designed so that the greater the length indicated by the information which is related to the dimension of the sheet S of recording paper used to output two-sided prints, and which is obtained by the sheet dimension obtaining means, the greater the value to be added to the value in the second accumulating means each time a two-sided print is outputted by the image forming apparatus 100.

Figure 6:
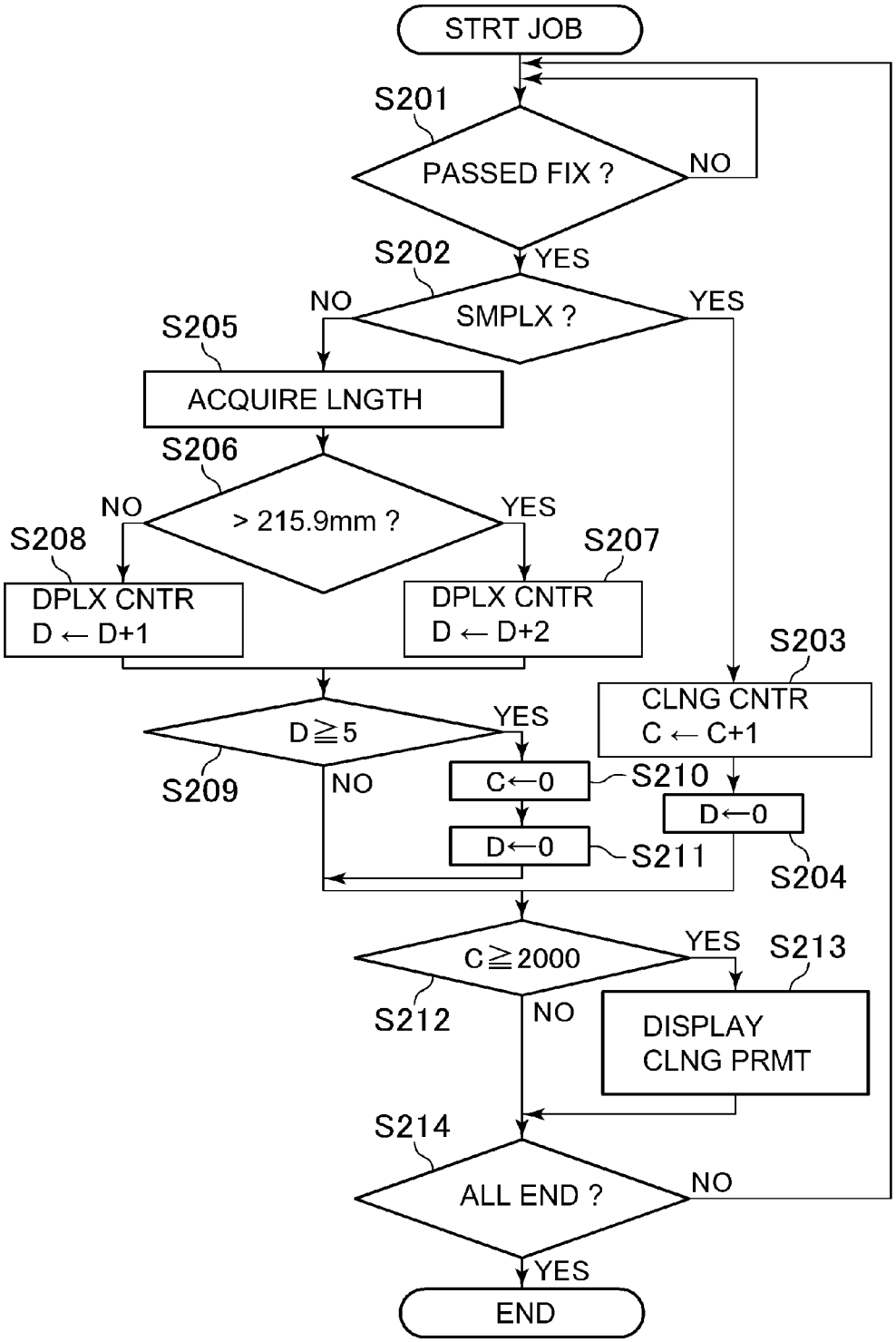
FIG. 6 is a flowchart of the sequence for deciding whether or not the cleaning operation for cleaning the pressure roller needs to be carried out by the image forming apparatus in the first embodiment.

FIG. 6 is a flowchart for describing the process carried out by the CPU 201 to decide whether or not the pressure roller 52 in this embodiment needs to be cleaned.

As a printing job is started, the CPU 201 remains on standby until a sheet S of recording paper moves through the fixing device 50 (S201).

As the CPU 201 determines in Step S201 that a sheet S of recording paper has moved through the fixing device 50, it decides whether or not the sheet S is for a one-sided print (S202).

In a case where the CPU 201 determines, in Step 202, that the sheet S of recording paper is for a one-sided print, it adds 1 to the cleaning counter (S203).

Then, the CPU 201 clears the two-sided print counter D (S204), and proceeds to Step S212.

On the other hand, in a case where the CPU 201 determines in Step S202 that the sheet S of recording paper is not for a one-sided print, that is, the sheet S is for a two-sided print, it increases the value in the two-sided print counter D in the following manner.

First, the CPU 201 obtains the length of the sheet S of recording paper in terms of the recording medium conveyance direction, from the information regarding the sheet S, of which the CPU 201 is informed through the external I/F 220 (S205).

Next, the CPU 201 decides whether or not the length of the sheet S of recording paper in terms of the recording medium conveyance direction is greater than 215.9 mm (S206).

If the CPU 201 determines, in Step S206, that the sheet S of recording paper is longer than 215.9 mm, it adds 2 to the value in the two-sided print counter (S207).

On the other hand, if the CPU 201 determines in Step S206 that the length of the sheet S of recording paper in terms of the recording medium conveyance direction is no more than 215.9 mm, it adds 1 to the value in the two-sided print counter D (S208).

As the CPU 201 finishes the process for increasing the value in the two-sided print counter D as described above, it decides whether or not the value in the two-sided print counter D is no less than 5 (S209).

If the CPU 201 determines in Step S209 that the value in the two-sided print counter D is no less than 5, it clears the cleaning counter C (S210).

Next, the CPU 201 clears the two-sided print counter D (S211).

On the other hand, if the CPU 201 determines in Step S209 that the value in the two-sided print counter D is no more than 5, it proceeds to Step S212.

Incidentally, to what degree the image forming apparatus 100 needs to be operated in the two-sided printing mode to remove the contaminative toner and $CaCO_3$ particles on the pressure roller 52 to such a degree that they become negligible can be confirmed in advance by experiments. In this embodiment, it was confirmed in advance through experiments that in a case where sheets S of recording medium used for a given image forming operation in the two-sided printing mode is no more than 215.9 mm in length in terms of the recording medium conveyance direction, as long as no less than five of them are conveyed through the fixing device 50, the pressure roller 52 is satisfactorily cleaned, whereas in a case where sheets S of recording medium used for a given image forming operation in the two-sided printing mode is no less than 215.9 mm in terms of the recording medium conveyance direction, as long as no less than 2.5 of them is used, the pressure roller 52 is satisfactorily cleaned. In this embodiment, therefore, it is decided in Step S209 whether or not the value in the two-sided print counter D is no less than 5.

Next, the CPU 201 decides, as follows, whether or not the pressure roller 52 needs to be cleaned. That is, the CPU 201 decides whether or not the value in the cleaning counter C is no less than 2,000 (S212).

If the CPU 201 determines in Step S212 that the value in the cleaning counter C is no less than 2,000, it outputs a message, on the display 302 of the control panel 600, which indicates that the pressure roller 52 needs to be cleaned (FIG. 3) (S213).

On the other hand, if the CPU 201 determines in Step S212 that the value in the cleaning counter C is no more than 2,000, it proceeds to Step S214.

The threshold value to be used to decide whether or not the pressure roller 52 is in the state in which it needs to be cleaned may be set in advance through experiments. In this embodiment, it was confirmed through experiments that as roughly 2,000 one-sided prints were continuously outputted, the contaminative toner and $CaCO_3$ particles began to adhere to the pressure roller 52. This is why 2,000 is set as the threshold value for the cleaning counter C, in Step S212, in this embodiment.

Incidentally, the image forming apparatus 100 may be structured so that this threshold value is optional. That is, it can be changed to change the timing with which the above-described message is shown on the display portion 302 of the control panel 600.

Lastly, the CPU 201 decides whether or not all the prints to be outputted by the on-going printing operation have been outputted (S214). If it determines that they have not been, it returns to Step S201, and remains on standby until the next sheet S of recording paper moves through the fixing device 50.

As described above, the image forming apparatus 100 in this embodiment has a toner image forming means which form a toner image on a sheet S of recording paper. It has also the fixing means 50 equipped with the rotational fixing member 51 and rotational pressure applying member 52, which fix the toner image formed on the sheet S of recording paper by the toner image forming means, to the sheet S, while conveying the sheet S with the sheet S pinched between the rotational fixing member 51 and rotational pressure applying member 52. It has also the recording medium conveying means B, which places upside down the sheet S of recording paper which is bearing the toner image fixed thereto by the fixing means 50, and conveys the sheet S to the toner image forming means 1 and fixing means 50 for the second time. Further, it has the executing means 201 which makes the image forming apparatus 100 operate in the cleaning mode. In the cleaning mode, a preset toner image is formed on one of the two surfaces of a sheet S of recording paper by the toner image forming means 1 and is fixed to the sheet S by the fixing means 50. Then, the sheet S is placed upside down by the recording medium conveying means B, and is delivered to the toner image forming means 1 and fixing means 50, in the listed order, for the second time, to clean the rotational pressure applying member 52. Further, the image forming apparatus 100 has the accumulating means C which cumulatively stores the number of one-sided prints which were continuously outputted by the image forming apparatus. Further, the image forming apparatus 100 has the informing means 600 which prompts an operator (user) that the fixing means 50 needs to be operated in the cleaning mode, as the value in the accumulating means C exceeds a preset value. Further, the image forming apparatus 100 has the resetting means 201 which resets the value in the accumulating means C as the number of the continuously outputted two-sided prints reaches a preset value. In particular, in this embodiment, the toner image to be formed on the sheet S of recording paper by the toner image forming means 1 to clean the rotational pressure applying member 52, is longer in terms of the recoding medium conveyance direction than the circumferential length of the rotational pressure applying member 52. Also in this embodiment, the image forming apparatus 100 has multiple recording medium storing portions 61-64 which store sheets S of recording medium. Thus, in the cleaning mode, a sheet S of recording paper which is largest in size (width, or dimension in terms of direction perpendicular to recording medium conveyance direction) among the sheets S of recording paper stored in the multiple recording medium storing portions 61-64 is fed to the toner image forming means I. Further, in this embodiment, in the cleaning mode, it is on only one of the two surfaces of a sheet S of recording paper that the above-described toner image for cleaning is formed by the toner image forming means I.

As will be evident from the detailed description of this embodiment of the present invention, the present invention makes it possible for the image forming apparatus 100 to decide whether or not the pressure roller 52 needs to be cleaned, without employing a dedicated sensor such as an optical sensor. Thus, it can provide a fixing device (apparatus) which is substantially less in the amount of the image contamination attributable to the contamination of the pressure roller 52, and also, less in cost and size than a fixing device (apparatus) in accordance with the prior art. That is, the present invention makes it possible to provide a fixing device which is significantly simpler in the structure of the rotational member of its fixing means, and also, can simply determines the timing with which the rotational member of the fixing means is to be cleaned, than any fixing device (apparatus) in accordance with the prior art.

(Embodiment 2)

Next, another embodiment of the present invention is described. In terms of the basic structure and operation, this embodiment is the same as the first embodiment. Thus, the elements of the image forming apparatus in this embodiment which are the same as, or equivalent to, the counterparts in the first embodiment are given the same referential codes as those given to the counterparts, one for one, and are not described here.

The difference of this embodiment from the first embodiment is as follows. That is, in this embodiment, the image forming apparatus 100 is provided with the second accumulating means which is different from the second accumulating means in the first embodiment, in that it accumulates the information related to the amount of the toner used to form a toner image on one (first) of the two surfaces of a sheet S of recording paper in the two-sided printing mode. Thus, the altering means, in this embodiment, for altering the value in the first accumulating means which accumulates the information related to the amount by which the image forming apparatus 100 is continuously operated in the one-sided printing mode, reduces the value in the first accumulating means, as the value in the second accumulating means exceeds a preset value.

The typical information related to the amount of the toner used to form a toner image on the first surface of the sheet S of recording paper in the two-sided printing mode is such information as pixel count. However, the information does not need to be limited to pixel count. For example, it may be such information as the cumulative value of the pixel density, for example. In other words, the information has only to be such information that is related to the amount of the toner used to form a toner image on the first surface of a sheet S of recording paper.

More concretely, in the first embodiment, as the image forming apparatus 100 is operated in the two-sided printing mode, the value in the two-side-print counter D by a preset value, based on the length of each sheets of recording paper in terms of the recording medium conveyance direction. If the value in the two-sided print counter D exceeds a preset threshold value, the CPU 201 determines that the pressure roller 52 does not need to be cleaned, and clears the cleaning counter C.

In comparison, in this embodiment, as the image forming apparatus 100 is operated in the two-sided printing mode, the CPU 201 obtains the video count V for each of the monochromatic toner images of the primary color on the first surface of a sheet S of recording paper, and then, obtains the sum Vsum of the video counts V as will be described later in detail. Then, if the sum Vsum of the video counts V exceeds a preset threshold value, the CPU 201 determines that the pressure roller 52 does not need to cleaned, and clears the cleaning count C.

That is, the contaminative toner and $CaCO_3$ particles on the peripheral surface of the pressure roller 52 are discharged from the image forming apparatus 100 by being transferred onto the toner image on the first surface of a sheet S of recording paper. Therefore, the smaller the amount of the toner in the toner image on the first surface of the sheet S is, the smaller the amount of the contaminative toner and $CaCO_3$ particles which have to be removed from the peripheral surface of the pressure roller 52. In other words, the greater the amount of the toner in the toner image formed on the first surface of the sheet S is, the greater the amount of the contaminative toner and $CaCO_3$ particles which have to be removed from the peripheral surface of the pressure roller 52. Therefore, to what degree the contaminative toner and $CaCO_3$ particles on the peripheral surface of the pressure roller 52 were removed can be estimated by counting the amount of the toner in the toner image formed on the first surface of the sheet S in the two-sided printing mode.

Figure 7:
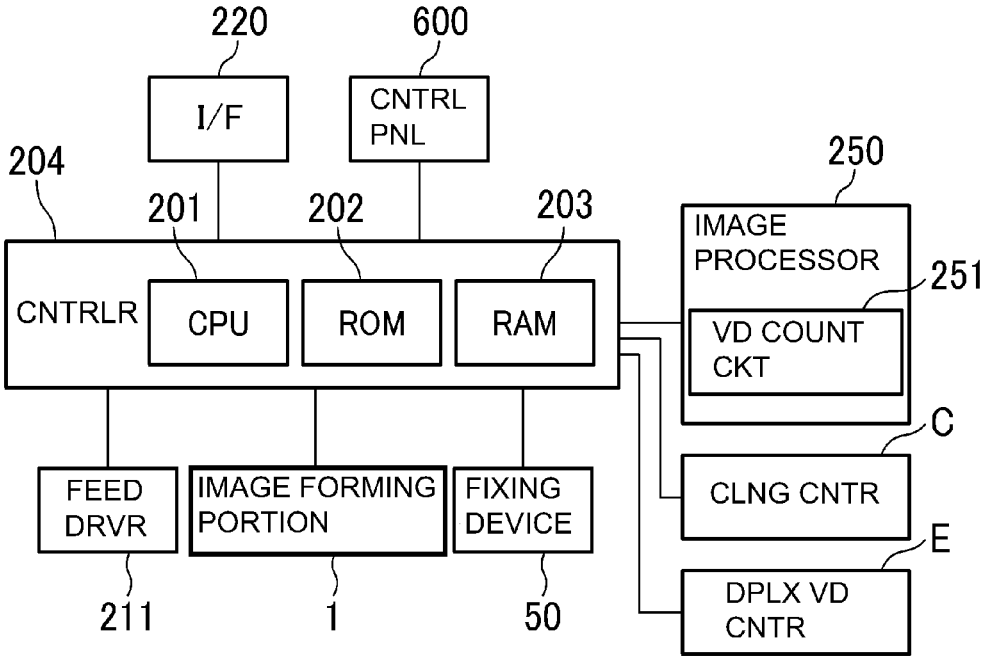
FIG. 7 is a block diagram of the essential portions of the image forming apparatus in the second embodiment of the present invention, and shows the relationship among the essential portions in terms of their control.

FIG. 7 is a block diagram of the essential portions of the image forming apparatus 100 in this embodiment, and shows how the essential portions are controlled.

The image processing section 250 processes the image data inputted from the external I/F 220, and sends the processed image data to the exposing device 13 of the image forming portion I. The image processing section 250 has a video counting internal circuit 251 as a video counting means. It is capable of counting the pixels of the toner image formed on a sheet S of recording paper per page (it is capable of obtaining video count value). The CPU 201 obtains the sum Vsum of the video count value V of the toner image formed on the first surface of a sheet S of recording paper in the two-sided printing mode, per primary color, based on the video count value V per primary color. Then, it stores the sum Vsum of this video count, as the information related to the amount of the toner in the toner image on the first surface of the sheet S in the two-sided printing mode, in a video counter E for the two-sided printing mode, which is a storing means as the second accumulating means.

Figure 8:
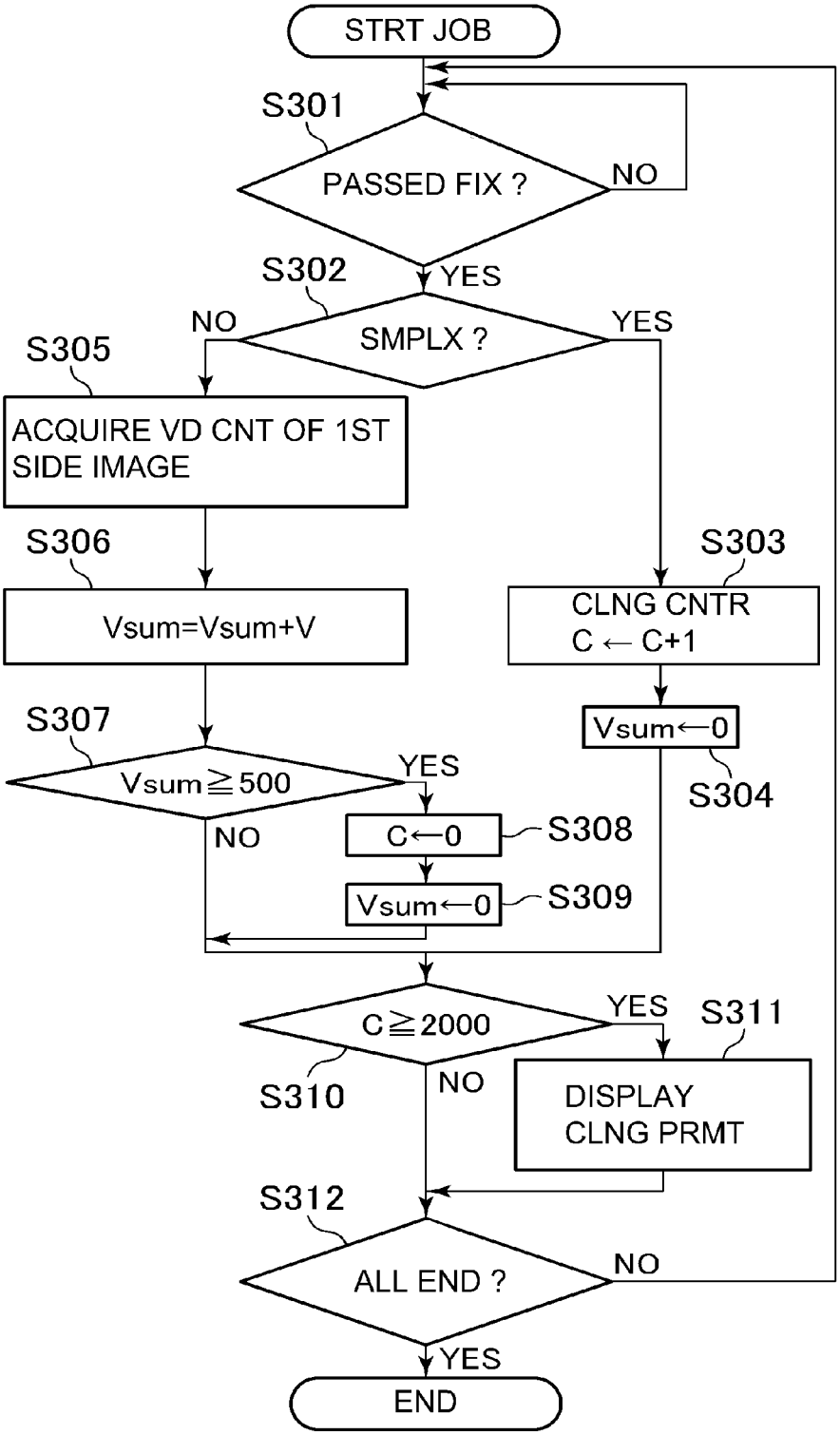
FIG. 8 is a flowchart of the sequence for deciding whether or not the cleaning operation for cleaning the pressure roller needs to be carried out by the image forming apparatus in the second embodiment.

FIG. 8 is a flowchart for describing the operational sequence, in this embodiment, to be carried out by the CPU 201 to decide whether or not the pressure roller 52 needs to be cleaned.

As a printing job is started, the CPU 201 remains on standby until a sheet S of recording paper moves through the fixing device 50 (S301).

If the CPU 201 determines in Step S301 that a sheet S of recording paper moved through the fixing device 50, it decides whether or not the sheet S is for a one-sided print (S302).

If the CPU 201 determines in Step S302 that the sheet S is for a one-sided print, it adds 1 to the cleaning counter C (S303).

Then, the CPU 201 clears the two-sided printing mode video counter E; it reduces the value Vsum in the video counter E to zero (S304). Then, it proceeds to Step S310.

On the other hand, if the CPU 201 determines in Step S202 that the sheet S of recording paper is not for a one-sided print, that is, if it determines that the sheet S is for a two-sided print, it increases the value Vsum in the video counter E in the following manner.

First, the CPU 201 obtains the video count value V of the image formed on the first surface of the sheet S of recording paper, per primary color (S305). This video count value V is such a value that is obtained by the video counting circuit 251, based on the image data transferred thereto through the external I/F 220.

Then, the CPU 201 adds the video count value V of the image formed on the first surface of the sheet S, per primary color, to the value Vsum in the two-sided printing mode video counter E (S306).

Next, the CPU 201 decides whether or not the value Vsum in the two-side video counter E is no less than 500 (S307).

What kind of toner image in terms of toner consumption has to be formed on the first surface of a sheet S of recording paper for a two-sided print to reduce the contaminative toner and $CaCO_3$ particles on the peripheral surface of the pressure roller 52 to such a degree that they become ignorable can be determined in advance by experiments. In the case of this embodiment, it was confirmed by experiments that the amount of toner has only to be equal to the amount of the toner in the solid toner image which was formed on a sheet S of recording paper of A4 size, and which was large enough to cover virtually the entirety of one of the two surfaces of the sheet S. The video count of a solid monochromatic toner image which is large enough to cover the entirety of one of the two surfaces of a sheet S of recording paper of size A4 is roughly 500. In this embodiment, therefore, 500 is used as the threshold value in Step S307.

If the CPU 201 determines in Step S307 that the value Vsum in the video counter E is no less than 500, it clears the cleaning counter C (S308).

Then, the CPU 201 clears the two-sided printing mode video counter E; it reduces the value in the counter E to zero (S309).

On the other hand, if the CPU 201 determines in Step S309 that the sum Vsum of the video count is not more than 500, it proceeds to Step S310.

Thereafter, the CPU 201 decides whether or not the pressure roller 52 needs to be cleaned, based on the value in the cleaning counter C, as in the first embodiment. The processes to be carried out in Steps S310, S311 and S312 are the same as those to be carried out in Steps S212, S213 and S214 (FIG. 6), respectively, in the first embodiment, and therefore, there are not described here.

As described above, the effects obtainable by this embodiment are the same as those obtainable by the first embodiment. Further, whether or not the pressure roller 52 needs to be cleaned can be decided based on the degree to which the pressure roller 52 is cleaned as the image forming apparatus is operated in the two-sided printing mode.

(Miscellanies)

Heretofore, the present invention was described with reference to the preferred embodiments of the present invention. However, these embodiments are not intended to limit the present invention in scope.

In the above-described embodiments, the operation for cleaning the rotational member, with which the fixing means is provided, is carried out by the image forming apparatus in response to the instruction given by the operator. However, these embodiments are not intended to limit the present invention in terms of how the cleaning operation is initiated. For example, an image forming apparatus may be designed so that as it is determined that the rotational member needs to be cleaned, and the cleaning timing indicating means indicates the timing with which the cleaning operation needs to be carried out, the operation for cleaning the rotational member is automatically carried out by the executing means for carrying the cleaning operation. In this case, the executing means is enabled to carry out the cleaning operation for cleaning the rotational member, with an optimal timing, while no image is formed, after it is determined that the rotational member needs to be cleaned. The examples of the period in which no image is formed during a given image forming operation are: the period immediately after an image forming apparatus is turned on, and the period immediately after an image forming apparatus is restarted while it is kept in the sleep mode, that is, the period in which the preparatory operation in which the rotational members are idly rotated multiple times; the period from when the a print signal (image formation start signal) is inputted and to when the image forming apparatus starts actually writing an image based on the information of the image to be formed, in which the preset preparatory operation to be carried out, and in which the rotational members are idly rotated multiple times; sheet intervals which correspond to the distance between the consecutively conveyed two sheets of recording paper; and period immediately after the completion of a given image forming operation, in which a preset post-image formation operation (preparatory operation for next image formation) is carried out.

For example, in a case where an image forming apparatus is designed so that as the cumulative value which shows the amount by which the image forming apparatus is actually operated in the one-sided printing mode reaches a preset value, the on-going printing job is automatically interrupted and the apparatus is operated in the cleaning mode (forced cleaning operation). In this case, as soon as the cleaning operation is ended, the interrupted printing job is restarted after the cumulative value obtained in the one-sided printing mode is reset. If the timing with which a print job is ended coincides with the timing with which the timing to start operating the image forming apparatus in the cleaning mode, it may be during the so-called post-rotation period that the image forming apparatus is operated in the cleaning mode. Further, in a case where the cumulative value obtained in the one-sided printing mode reaches the preset value during an image forming operation, and the number of prints which has yet to be outputted by the on-going printing job is relatively small, the on-going printing job does not need to be interrupted for cleaning the pressure roller; the image forming apparatus may be operated in the cleaning mode during the post-rotation period. In other words, instead of the above-described message which prompts an operator to put the image forming apparatus in the cleaning mode, a message which indicates that the image forming apparatus is being mandatorily operated in the cleaning mode, is shown on the display of the control panel. In this case, the image forming apparatus has: the accumulating means which cumulatively stores the number of times prints are continuously outputted by the image forming apparatus while the apparatus is operated in the one-sided printing mode, that is, the mode in which a toner image is formed only one of the two surfaces of a sheet of recording paper; and executing means which makes the image forming apparatus operate in the cleaning mode as the value in the accumulating means is no less than a preset value. Also in this case, the image forming apparatus may be provided with the resetting means for resetting the accumulating means as the number of prints outputted by the image forming apparatus which the apparatus is operated in the two-sided printing mode reaches a preset value.

Further, the image forming apparatus may be designed so that in a case where it is determined that the rotational member of the fixing means needs to be cleaned, and the prompting means shows the timing with which the image forming apparatus is to be operated in the cleaning mode, a message that prompts an operator to remove the rotational member of the fixing means and clean the rotational member, is given to the operator.

Further, the image forming apparatuses in the above-described embodiments of the present invention were described as image forming apparatuses of the so-called intermediary transfer type. However, the present invention is also applicable to an image forming apparatus of the so-called direct transfer type, which is well known among people in the business to which the present invention is related. The effects of such application of the present invention are the same as those of the preceding embodiments. An image forming apparatus of the so-called direct transfer type has an endless recording sheet conveyance belt, or the like, as a recording sheet bearing member, which bears and conveys a sheet of recording paper, in place of the intermediary transferring member which an image forming apparatus of the intermediary transfer type has. Thus, the toner images, different in color, formed on the photosensitive members of the image forming stations, one for one, are transferred in layers onto a sheet of recording paper borne by the recording medium bearing member, and then, are fixed to the sheet of recording paper.

The application of the present invention is not limited to a color image forming apparatus. That is, the present invention is also applicable to a monochromatic image forming apparatus, and the effects of the application of the present invention to a monochromatic image forming apparatus are the same as those obtainable by the application of the present invention to a color image forming apparatus.

Further, in the above-described embodiments, the pair of rotational members which constitute the fixing device include fixation belt and pressure roller. However, the pair may be constituted by a fixation roller and a pressing belt, or both of them may be rollers or belts. Further, both of the rotational members may be provided with respective heat sources.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 239337/2012 filed Oct. 30, 2012 which is hereby incorporated by reference.

What is claimed is:

1. An image forming apparatus comprising:

a toner image forming portion configured to form a toner image on a recording paper;

a fixing portion including a first rotatable member and a second rotatable member to fix the toner image on the recording paper while nipping and feeding the recording paper carrying the toner image formed by said toner image forming portion; a feeding portion configured and positioned to reverse a facing orientation of the recording paper on which the toner image is fixed by said fixing portion and refeed the recording paper to said toner image forming portion and said fixing portion; an executing portion configured to execute an operation in a cleaning mode in which a predetermined toner image is formed and fixed on one side of the recording paper by said toner image forming portion and said fixing portion, and thereafter, the recording paper being refed by said feeding portion to said toner image forming portion and then to said fixing portion with the reversed facing orientation, so that the second rotatable member is cleaned;

a first integrating portion configured to integrate number of the executions of the operations of a simplex mode in which the toner image is formed only on the one side of the recording paper;

a notifying portion configured to notify for promoting execution of the cleaning mode when the integrated value of said first integrating portion is not less than a predetermined value;

a second integrating portion configured to integrate a number of executions of operations of a duplex mode in which toner images are formed on both sides of the recording paper; and a correcting portion configured to correct the integrated value of said first integrating portion in accordance with the integrated value of said second integrating portion.

2. An apparatus according to claim 1, wherein said correcting portion resets the integrated value of said first integrating portion when the integrated value of said second integrating portion reaches a predetermined value.

3. An apparatus according to claim 2, further comprising an acquiring portion configured to acquire a length of the recording paper in a feeding direction in the operation in the duplex mode, wherein said correcting portion corrects the integrated value of said first integrating portion in accordance with the length acquired by said acquiring portion.

4. An apparatus according to claim 1, wherein said correcting portion effects deduction from the integrated value of said first integrating portion when the integrated value of said second integrating portion reaches a predetermined value.

5. An apparatus according to claim 4, further comprising an acquiring portion configured to acquire a length of the recording paper in a feeding direction in the operation in the duplex mode, wherein said correcting portion corrects the integrated value of said first integrating portion in accordance with the length acquired by said acquiring portion.

6. An apparatus according to claim 1, wherein the predetermined toner image covers an entire area in which an image can be formed.

7. An apparatus according to claim 6, wherein the predetermined toner image comprises a plurality of different color toner layers.

8. An apparatus according to claim 1, further comprising a plurality of accommodating portions configured to accommodate the recording paper, and wherein in the operation of the cleaning mode, the executing portion selects a widest recording paper, for feeding to the toner image forming portion, among the recording papers accommodated in the plurality of accommodating portions.

9. An apparatus according to claim 6, wherein said toner image forming portion forms the predetermined toner image only on the one side of the recording paper in the cleaning mode.

10. An image forming apparatus comprising:

a toner image forming portion configured to form a toner image on a recording paper;

a fixing portion including a first rotatable member and a second rotatable member to fix the toner image on the recording paper while nipping and feeding the recording paper carrying the toner image formed by said toner image forming portion; a feeding portion configured and positioned to reverse a facing orientation of the recording paper on which the toner image is fixed by said fixing portion and refeed the recording paper to said toner image forming portion and said fixing portion; a first integrating portion configured to integrate a number of the executions of the operations of a simplex mode in which the toner image is formed only on one side of the recording paper;

an executing portion configured to execute, when the integrated value of said first integrating portion is not less than a predetermined value, an operation in a cleaning mode in which a predetermined toner image is formed and fixed on the one side of the recording paper by said toner image forming portion and said fixing portion, and thereafter, the recording paper being refed by said feeding portion to said toner image forming portion and then to said fixing portion with the reversed facing orientation, so that the second rotatable member is cleaned;

a second integrating portion configured to integrate a number of executions of operations of a duplex mode in which toner images are formed on both sides of the recording paper; and a resetting portion configured to reset the integrated value of said first integrating portion when the integrated value of said second integrating portion reaches a predetermined value.

11. An apparatus according to claim 10, wherein the predetermined toner image covers an entire area in which an image can be formed.

12. An apparatus according to claim 11, wherein the predetermined toner image comprises a plurality of different color toner layers.

13. An apparatus according to claim 10, further comprising a plurality of accommodating portions configured to accommodate the recording paper, and wherein in the operation of the cleaning mode, the executing portion selects a widest recording paper, for feeding to the toner image forming portion, among the recording papers accommodated in the accommodating portions.

14. An apparatus according to claim 11, wherein said toner image forming portion forms the predetermined toner image only on the one side of the recording paper in the cleaning mode.

15. An image forming apparatus comprising:

a toner image forming portion configured to form a toner image on a recording paper;

a fixing portion including a first rotatable member and a second rotatable member to fix the toner image on the recording paper while nipping and feeding the recording paper carrying the toner image formed by the toner image forming portion;

a feeding portion configured and positioned to reverse a facing orientation of the recording paper on which the toner image is fixed by the fixing portion and refeed the recording paper to the toner image forming portion and the fixing portion;

an executing portion configured to execute an operation in a cleaning mode in which a predetermined toner image is formed and fixed on one side of the recording paper by the toner image forming portion and the fixing portion, and thereafter, the recording paper being refed by the feeding portion to the toner image forming portion and then to the fixing portion with the reversed facing orientation, so that the second rotatable member is cleaned;

a counting portion configured to count a number of the executions of the operations of a simplex mode in which the toner image is formed only on the one side of the recording paper;

a notifying portion configured to notify for promoting execution of the cleaning mode when the counted value of the counting portion is not less than a predetermined value; and a correcting portion configured to correct the counted value of the counting portion in accordance with an execution of a duplex mode in which toner images are formed on both sides of the recording paper.

16. An apparatus according to claim 15, wherein the correcting portion resets the counted value in accordance with the execution of the duplex mode.

17. An apparatus according to claim 16, further comprising an acquiring portion configured to acquire a length of the recording paper in a feeding direction in the operation in the duplex mode, wherein the correcting portion corrects the counted value in accordance with the length acquired by the acquiring portion.

18. An apparatus according to claim 15, wherein the correcting portion effects deduction from the counted value in accordance with the execution of the duplex mode.

19. An apparatus according to claim 18, further comprising an acquiring portion configured to acquire a length of the recording paper in a feeding direction in the operation in the duplex mode, wherein the correcting portion corrects the counted value in accordance with the length acquired by the acquiring portion.

20. An apparatus according to claim 15, wherein the predetermined toner image covers an entire area in which the image can be formed.

21. An apparatus according to claim 20, wherein the predetermined toner image comprises a plurality of different color toner layers.

22. An apparatus according to claim 15, further comprising a plurality of accommodating portions configured to accommodate the recording paper, and wherein in the operation of the cleaning mode, the executing portion selects a widest recording paper, for feeding to the toner image forming portion, among the recording papers accommodated in the plurality of accommodating portions.

23. An apparatus according to claim 20, wherein the toner image forming portion forms the predetermined toner image only on the one side of the recording paper in the cleaning mode.

24. An image forming apparatus comprising:

a toner image forming portion configured to form a toner image on a recording paper;

a fixing portion including a first rotatable member and a second rotatable member to fix the toner image on the recording paper while nipping and feeding the recording paper carrying the toner image formed by the toner image forming portion;

a feeding portion configured and positioned to reverse a facing orientation of the recording paper on which the toner image is fixed by the fixing portion and refeed the recording paper to the toner image forming portion and the fixing portion;

a counting portion configured to count a number of the executions of the operations of a simplex mode in which the toner image is formed only on one side of the recording paper;

an executing portion configured to execute, when the counted value of the counting portion is not less than a predetermined value, an operation in a cleaning mode in which a predetermined toner image is formed and fixed on the one side of the recording paper by the toner image forming portion and the fixing portion, and thereafter, the recording paper being refed by the feeding portion to the toner image forming portion and then to the fixing portion with the reversed facing orientation, so that the second rotatable member is cleaned; and a resetting portion configured to reset the counted value of the counting portion in accordance with an execution of a duplex mode in which toner images are formed on both sides of the recording paper.

25. An apparatus according to claim 24, wherein the predetermined toner image covers an entire area in which the image can be formed.

26. An apparatus according to claim 25, wherein the predetermined toner image comprises a plurality of different color toner layers.

27. An apparatus according to claim 24, further comprising a plurality of accommodating portions configured to accommodate the recording paper, and wherein in the operation of the cleaning mode, the executing portion selects a widest recording paper, for feeding to the toner image forming portion, among the recording papers accommodated in the plurality of accommodating portions.

28. An apparatus according to claim 24, wherein the toner image forming portion forms the predetermined toner image only on the one side of the recording paper in the cleaning mode.

* * * * *